US008037818B2

(12) United States Patent
Dawley et al.

(10) Patent No.: US 8,037,818 B2
(45) Date of Patent: Oct. 18, 2011

(54) PRINT UNIT WITH SINGLE MOTOR DRIVE PERMITTING AUTOPLATING

(75) Inventors: Douglas Joseph Dawley, Dover, NH (US); Brian Joseph Gentle, Rochester, NH (US); Erik John Ramsay, Nottingham, NH (US)

(73) Assignee: Goss International Americas, Inc., Durham, NH (US)

( * ) Notice: Subject to any disclaimer, the term of this patent is extended or adjusted under 35 U.S.C. 154(b) by 130 days.

(21) Appl. No.: 11/401,140

(22) Filed: Apr. 10, 2006

(65) Prior Publication Data

US 2006/0225590 A1 Oct. 12, 2006

Related U.S. Application Data

(60) Provisional application No. 60/670,187, filed on Apr. 11, 2005.

(51) Int. Cl.

| | |
|---|---|
| ***B41F 7/02*** | (2006.01) |
| ***B41F 13/00*** | (2006.01) |
| ***B41F 13/20*** | (2006.01) |
| ***B41F 27/12*** | (2006.01) |

(52) U.S. Cl. ..... 101/218; 101/220; 101/247; 101/477

(58) Field of Classification Search ..... 101/217–220, 101/247, 248, 477

See application file for complete search history.

(56) References Cited

U.S. PATENT DOCUMENTS

| | | | | |
|---|---|---|---|---|
| 2,172,364 A | | 9/1939 | De Manna | 271/80 |
| 3,527,165 A | * | 9/1970 | Harless | 101/143 |
| 4,240,346 A | | 12/1980 | Landis et al. | 101/139 |
| 4,458,591 A | | 7/1984 | Guaraldi | 101/247 |
| 4,620,480 A | | 11/1986 | Hermach | 101/179 |
| 4,677,911 A | | 7/1987 | Hermach | 101/218 |
| 4,807,527 A | | 2/1989 | Knauer | 101/216 |
| 4,823,693 A | | 4/1989 | Koebler | 101/218 |
| 4,831,926 A | | 5/1989 | Bowman et al. | 101/138 |

(Continued)

FOREIGN PATENT DOCUMENTS

DE 2046131 3/1972

(Continued)

OTHER PUBLICATIONS

Mike Thompson, Sunday 2000—Auto Transfer "Zero Makeready Format" WOA Conference, Nashville, TN May 7, 2003, pp. 1-14.

(Continued)

*Primary Examiner* — Ren Yan
*Assistant Examiner* — Marissa Ferguson Samreth
(74) *Attorney, Agent, or Firm* — Davidson, Davidson & Kappel, LLC

(57) ABSTRACT

A web offset print unit includes a first plate cylinder, a first blanket cylinder selectively in contact with the first plate cylinder, a second blanket cylinder, the web passing between the first and second blanket cylinders, the second blanket cylinder and first blanket cylinder being selectively disengageable from the web in a throw-off position to permit the web to pass between the first and second blanket cylinders, and a second plate cylinder selectively engageable with the second blanket cylinder. A single drive motor drives the first plate cylinder, first blanket cylinder, second blanket cylinder and second plate cylinder when the first and second blanket cylinders engage the web and the single drive motor rotates the first and second plate cylinders when the first and second blanket cylinders are in the throw-off position. Autoplating during the throw-off position thus is possible.

21 Claims, 6 Drawing Sheets

U.S. PATENT DOCUMENTS

| | | | | | |
|---|---|---|---|---|---|
| 4,875,936 | A | | 10/1989 | Hermach | 101/218 |
| 4,913,048 | A | | 4/1990 | Tittgemeyer | 101/141 |
| 4,932,321 | A | | 6/1990 | Hermach | 101/211 |
| 4,934,265 | A | | 6/1990 | Knauer | 101/177 |
| 5,003,889 | A | | 4/1991 | Glunz et al. | 101/228 |
| 5,005,475 | A | | 4/1991 | Knauer | 101/218 |
| 5,042,788 | A | | 8/1991 | Bowman et al. | 270/21.1 |
| RE33,944 | E | | 6/1992 | Knauer | 101/216 |
| 5,161,463 | A | | 11/1992 | Knauer et al. | 101/220 |
| 5,191,835 | A | * | 3/1993 | Blanchard | 101/148 |
| 5,237,920 | A | | 8/1993 | Guaraldi | 101/216 |
| 5,241,905 | A | | 9/1993 | Guaraldi et al. | 101/216 |
| 5,245,923 | A | | 9/1993 | Vrotacoe | 101/217 |
| 5,289,770 | A | | 3/1994 | Hern | 101/226 |
| 5,301,609 | A | * | 4/1994 | Guaraldi et al. | 101/216 |
| 5,304,267 | A | | 4/1994 | Vrotacoe | 156/86 |
| 5,316,798 | A | | 5/1994 | Tittgemeyer | 427/409 |
| 5,323,702 | A | | 6/1994 | Vrotacoe | 101/217 |
| 5,337,664 | A | * | 8/1994 | Hannon | 101/218 |
| 5,394,797 | A | | 3/1995 | Doebler et al. | 101/216 |
| 5,415,092 | A | | 5/1995 | Hern | 101/226 |
| RE34,970 | E | | 6/1995 | Tittgemeyer | 101/141 |
| 5,421,260 | A | | 6/1995 | Doebler | 101/247 |
| 5,429,048 | A | | 7/1995 | Gaffney et al. | 101/217 |
| 5,440,981 | A | | 8/1995 | Vrotacoe et al. | 101/217 |
| 5,481,972 | A | | 1/1996 | Schmid | 101/216 |
| 5,488,903 | A | | 2/1996 | Koebler et al. | 101/375 |
| 5,492,062 | A | | 2/1996 | Harris et al. | 101/486 |
| 5,495,805 | A | | 3/1996 | Beisel et al. | 101/477 |
| 5,505,127 | A | | 4/1996 | Knauer | 101/218 |
| 5,522,316 | A | | 6/1996 | Singler | 101/479 |
| 5,524,539 | A | | 6/1996 | Doebler | 101/247 |
| 5,535,674 | A | | 7/1996 | Vrotacoe et al. | 101/216 |
| 5,535,675 | A | | 7/1996 | Gentle | 101/248 |
| 5,546,859 | A | | 8/1996 | Hern | 101/226 |
| 5,553,541 | A | | 9/1996 | Vrotacoe et al. | 101/217 |
| 5,560,292 | A | | 10/1996 | Knauer | 101/216 |
| 5,595,115 | A | | 1/1997 | Rau et al. | 101/142 |
| 5,651,314 | A | | 7/1997 | Gentle | 101/248 |
| 5,653,428 | A | | 8/1997 | Dufour et al. | 270/6 |
| 5,671,636 | A | | 9/1997 | Gagne et al. | 74/409 |
| 5,678,485 | A | * | 10/1997 | Guaraldi | 101/247 |
| RE35,646 | E | | 11/1997 | Guaraldi et al. | 101/216 |
| 5,683,202 | A | | 11/1997 | Hummel et al. | 403/325 |
| 5,699,735 | A | | 12/1997 | Stein et al. | 101/219 |
| 5,722,323 | A | * | 3/1998 | Whiting et al. | 101/218 |
| 5,746,132 | A | | 5/1998 | Parks et al. | 101/483 |
| 5,768,990 | A | | 6/1998 | Vrotacoe et al. | 101/217 |
| 5,771,804 | A | | 6/1998 | Knauer et al. | 101/183 |
| 5,782,182 | A | | 7/1998 | Ruckmann et al. | 101/177 |
| 5,794,529 | A | | 8/1998 | Dawley et al. | 101/216 |
| 5,802,975 | A | | 9/1998 | Prem et al. | 101/375 |
| 5,813,336 | A | * | 9/1998 | Guaraldi et al. | 101/218 |
| 5,832,821 | A | | 11/1998 | Petersen et al. | 101/216 |
| 5,894,796 | A | | 4/1999 | Gelinas | 101/219 |
| 5,901,648 | A | | 5/1999 | Roland et al. | 101/218 |
| 5,960,714 | A | | 10/1999 | Goettling et al. | 101/216 |
| 5,970,870 | A | | 10/1999 | Shiba et al. | 101/137 |
| 5,979,371 | A | | 11/1999 | Lewis | 122/494 |
| 5,996,492 | A | * | 12/1999 | Jurkewitz et al. | 101/228 |
| 6,019,039 | A | * | 2/2000 | Knauer et al. | 101/218 |
| 6,032,579 | A | | 3/2000 | Richards | 101/219 |
| 6,038,975 | A | | 3/2000 | Hoffmann et al. | 101/375 |
| 6,041,707 | A | | 3/2000 | Petersen et al. | 101/232 |
| 6,050,185 | A | | 4/2000 | Richards | 101/142 |
| 6,050,190 | A | | 4/2000 | Knauer et al. | 101/216 |
| 6,053,105 | A | | 4/2000 | Rudzewitz | 101/477 |
| 6,082,724 | A | | 7/2000 | Kahlig et al. | 270/52.14 |
| 6,085,651 | A | | 7/2000 | Defrance et al. | 101/247 |
| 6,093,139 | A | | 7/2000 | Belanger | 493/353 |
| 6,109,180 | A | | 8/2000 | Guaraldi et al. | 101/466 |
| 6,148,684 | A | | 11/2000 | Gardiner | 74/440 |
| 6,175,775 | B1 | | 1/2001 | Grunder | 700/111 |
| 6,186,064 | B1 | | 2/2001 | Dufour | 101/181 |
| 6,205,926 | B1 | | 3/2001 | Dufour | 101/492 |
| 6,213,016 | B1 | * | 4/2001 | Tsunashima | 101/218 |
| 6,216,592 | B1 | | 4/2001 | Knauer et al. | 101/247 |
| 6,227,110 | B1 | | 5/2001 | Zlatin | 101/218 |
| 6,227,111 | B1 | | 5/2001 | Dawley et al. | 101/218 |
| 6,289,805 | B1 | | 9/2001 | Douillard et al. | 101/247 |
| 6,302,021 | B1 | * | 10/2001 | Wadlinger | 101/232 |
| 6,343,547 | B1 | | 2/2002 | Callahan et al. | 101/216 |
| 6,345,574 | B1 | | 2/2002 | Charette et al. | 101/180 |
| 6,360,664 | B1 | | 3/2002 | Goettling et al. | 101/481 |
| 6,374,731 | B1 | | 4/2002 | Walczak et al. | 101/142 |
| 6,374,734 | B1 | | 4/2002 | Gaffney et al. | 101/376 |
| 6,386,100 | B1 | | 5/2002 | Gaffney et al. | 101/142 |
| 6,397,743 | B1 | | 6/2002 | Dauer et al. | 101/220 |
| 6,397,751 | B1 | | 6/2002 | Ramsay | 101/477 |
| 6,460,457 | B1 | | 10/2002 | Ramsay | 101/477 |
| 6,494,135 | B1 | | 12/2002 | Goettling et al. | 101/213 |
| 6,494,138 | B1 | | 12/2002 | Goettling et al. | 101/479 |
| 6,520,083 | B2 | | 2/2003 | Petersen et al. | 101/401.1 |
| 6,526,888 | B2 | | 3/2003 | Douillard et al. | 101/484 |
| 6,543,352 | B1 | | 4/2003 | Dilling et al. | 101/220 |
| 6,553,908 | B1 | | 4/2003 | Richards et al. | 101/248 |
| 6,557,467 | B1 | | 5/2003 | Dilling et al. | 101/220 |
| 6,615,726 | B2 | | 9/2003 | Douillard et al. | 101/483 |
| 6,647,876 | B2 | | 11/2003 | Emery et al. | 101/247 |
| 6,736,063 | B2 | * | 5/2004 | Murata | 101/247 |
| 6,739,251 | B2 | | 5/2004 | Gaffney et al. | 101/217 |
| 6,814,003 | B2 | * | 11/2004 | Tobe et al. | 101/477 |
| 6,820,547 | B2 | | 11/2004 | Fujiwara | 101/218 |
| 6,829,991 | B1 | * | 12/2004 | Eaton | 101/217 |
| 6,937,751 | B2 | | 8/2005 | Ritt et al. | 382/132 |
| 6,966,258 | B2 | | 11/2005 | Charette et al. | 101/180 |
| 6,986,305 | B2 | | 1/2006 | Knauer | 101/220 |
| 7,032,510 | B2 | | 4/2006 | Christel et al. | 101/216 |
| 2002/0033105 | A1 | | 3/2002 | Charette et al. | 101/220 |
| 2002/0078840 | A1 | | 6/2002 | Gaffney et al. | 101/217 |
| 2004/0050270 | A1 | * | 3/2004 | Gerner et al. | 101/216 |
| 2004/0083911 | A1 | | 5/2004 | Fujiwara | 101/247 |
| 2004/0206257 | A1 | | 10/2004 | Gaffney et al. | 101/217 |
| 2004/0237817 | A1 | * | 12/2004 | Rauh | 101/218 |
| 2005/0160928 | A1 | * | 7/2005 | Motard et al. | 101/217 |
| 2005/0160933 | A1 | | 7/2005 | Ruschkowski | 101/425 |

FOREIGN PATENT DOCUMENTS

| | | | |
|---|---|---|---|
| DE | 3543704 | A1 | 6/1987 |
| DE | 3716188 | A1 | 12/1987 |
| DE | 4138479 | A1 | 6/1993 |
| DE | 4337554 | A1 | 6/1994 |
| DE | 4412873 | A1 | 11/1994 |
| DE | 9018111 | U | 6/1995 |
| DE | 4408025 | A1 | 9/1995 |
| DE | 4435429 | A1 | 4/1996 |
| DE | 19501243 | A1 | 7/1996 |
| DE | 4143597 | C2 | 6/1998 |
| DE | 199038747 | A1 | 8/2000 |
| DE | 19919272 | A1 | 11/2000 |
| DE | 10013979 | A1 | 12/2000 |
| DE | 10008936 | A1 | 8/2001 |
| EP | 0225509 | A2 | 6/1987 |
| EP | 0388740 | B1 | 9/1990 |
| EP | 0421145 | B2 | 4/1991 |
| EP | 0549936 | A1 | 7/1993 |
| EP | 0581019 | B1 | 2/1994 |
| EP | 0596244 | A1 | 5/1994 |
| EP | 0644048 | A2 | 3/1995 |
| EP | 0683043 | B1 | 11/1995 |
| EP | 0685335 | B1 | 12/1995 |
| EP | 0697284 | B1 | 2/1996 |
| EP | 0741015 | B1 | 11/1996 |
| EP | 0749927 | B1 | 12/1996 |
| EP | 0782920 | B1 | 7/1997 |
| EP | 0813958 | B1 | 12/1997 |
| EP | 0813959 | B1 | 12/1997 |
| EP | 0845352 | A1 | 6/1998 |
| EP | 0862999 | B1 | 9/1998 |
| EP | 0956951 | B1 | 11/1999 |
| EP | 0958917 | B1 | 11/1999 |
| EP | 0995595 | B1 | 4/2000 |
| EP | 1075943 | A1 | 2/2001 |
| EP | 1075944 | B1 | 2/2001 |
| EP | 1075945 | A1 | 2/2001 |
| EP | 1132202 | B1 | 9/2001 |
| EP | 1155825 | A2 | 11/2001 |

| | | | |
|---|---|---|---|
| EP | 1167028 | A2 | 1/2002 |
| FR | 2787059 | | 6/2000 |
| GB | 2149149 | A | 6/1985 |
| GB | 2 273 464 | | 6/1995 |
| GB | 2309668 | A | 8/1997 |
| JP | 63-236651 | | 10/1988 |
| JP | 2003-182040 | | 7/2003 |
| WO | WO 03/000496 | A1 | 1/2003 |
| WO | WO 03/084747 | A1 | 10/2003 |

OTHER PUBLICATIONS

Harris Corporation, The Harris M-112 and M-122: Profits through Automation, pp. 1-4.
Jochen Pagenberg; Johannes Lang, Le Droit Allemand Des Brevets Et Des Modeles D'Utilite.
Von Marcel Jacomet, Regeln und Steuern mit unscharfer Logik; p. 94+.
Goss Sunday 2000 Automatic Transfer Provides Exclusive Zero-Makeready Advantages, Oct. 18, 2004 www.members.what-theythink.com/allsearch/article.cfm?id=17971&printer=pr.
Goss bietet Null-Rustzeiten-Vorteil, Oct. 2004, www.druckspiegel.de/archiv/news/2004/10/news.html.
Goss Sunday 2000 Automatic Transfer provides exclusive zero-makeready advantages, Oct. 10, 2004 www.gossinternational.com/index.php?src=news&prid=21&category=Commercial...
Heidelberg Introduces Web Offset Makeready Breakthrough, Feb. 6, 2004, pp. 1-3.
Web Offset, Issue No. 55, pp. 1-16, Published by Goss International Corporation 2004.
Rotoman S Printing Unit, 2005. www.man-roland.de/en/popups/pw0118/w0011/index.jsp.

* cited by examiner

PRINT UNIT WITH SINGLE MOTOR DRIVE PERMITTING AUTOPLATING

This application claims priority to U.S. Provisional Application No. 60/670,187 filed Apr. 11, 2005, and hereby incorporated by reference herein.

BACKGROUND

The present invention relates generally to printing presses and more specifically to web offset printing presses having removable sleeve-shaped blankets.

U.S. Pat. No. 4,240,346 describes for example a printing press with two blanket cylinders separable from each other to permit a blanket throw off.

In such presses, the blankets are offset from a vertical from each other, and in order to pass the web through the blankets when the blankets are offset, lead rolls or air bars are necessary to properly guide the web through the blankets. These guides can mark the printed product and also alter registration of the web between two printing print units, causes deteriorated print quality.

U.S. Pat. No. 5,678,485, hereby incorporated by reference herein, discloses a counterpoise and lift mechanism to permit a blanket cylinder to be cantilevered to permit a sleeve-shaped blanket to be slid on and off the cylinder body.

Semi-automatic or fully automatic plating (autoplating) mechanisms are known which permit plates to be attached to the plate cylinder. U.S. Pat. No. 5,495,805 for example is hereby incorporated by reference herein. The plate cylinder should be driven to permit such autoplating.

SUMMARY OF THE INVENTION

When throwing-off the blanket cylinder to permit axial removal of sleeves with a single motor drive unit, the blanket cylinder gears are disengaged so that autoplating of both plate cylinders using the single drive motor for the unit is not possible.

An object of the present invention is to permit a single drive motor to drive a print unit while still permitting a wide throw-off of the blanket and permitting autoplating.

The present invention provides a web offset print unit comprising:

a first plate cylinder;

a first blanket cylinder selectively in contact with the first plate cylinder;

a second blanket cylinder, the web passing between the first and second blanket cylinders, the second blanket cylinder and first blanket cylinder being selectively disengageable from the web in a throw-off position to permit the web to pass between the first and second blanket cylinders;

a second plate cylinder selectively engageable with the second blanket cylinder; and a single drive motor driving the first plate cylinder, first blanket cylinder, second blanket cylinder and second plate cylinder when the first and second blanket cylinders engage the web; and capable of rotating the first and second plate cylinders when the first and second blanket cylinders are in the throw-off position.

The first and second plate cylinders thus can be autoplated using the drive motor.

Preferably, the first and second plate cylinders each have an associated autoplating unit.

The present invention provides a web offset print unit comprising:

a first plate cylinder;

a first plate gear fixedly connected to the first plate cylinder;

a first blanket cylinder selectively in contact with the first plate cylinder;

a first blanket gear fixedly connected to the first blanket cylinder;

a second blanket cylinder, the web passing between the first and second blanket cylinders, the second blanket cylinder and first blanket cylinder being selectively disengageable from the web in a throw-off position to permit the web to pass between the first and second blanket cylinders;

a second blanket gear fixedly connected to the second blanket cylinder;

a second plate cylinder selectively engageable with the second blanket cylinder;

a second plate gear fixedly connected to the second plate cylinder;

a single motor driving the first plate gear, first blanket gear, second blanket gear and second plate gear, the first blanket gear and second blanket gear being engaged when the first and second blanket cylinders engage the web; and an at least one further gear connecting the first plate gear and the second plate gear in the throw-off position, the first and second blanket gears being disengaged in the throw-off position, the single motor driving the first plate gear, second plate gear and at least one further gear when the first and second blanket cylinders are in the throw-off position.

The at least one further gear may include two further gears, and may be engaged solely during throw-off or during both throw-off and when the web is engaged by the first and second blanket cylinders.

The present invention also provides a method for autoplating a first and a second plate cylinder of an offset print unit, the offset print unit also having a first and second blanket and a single drive motor, the method comprising the steps of throwing-off the first blanket cylinder from the second blanket cylinder to permit the web to pass between the first and second blanket cylinders without contact so as to define a throw-off mode, removing the first plate cylinder from the first blanket cylinder and the second plate cylinder from the second blanket cylinder during throw-off mode to permit changing a first blanket on the first blanket cylinder and a second blanket on the second blanket cylinder, respectively, contacting the first plate cylinder with the first blanket cylinder during throw-off mode to permit the first plate cylinder to be rotated by the single drive motor, and contacting the second plate cylinder with the second blanket cylinder during throw-off mode to permit the second plate cylinder to be rotated by the single drive motor.

DETAILED DESCRIPTION

Figure 1:
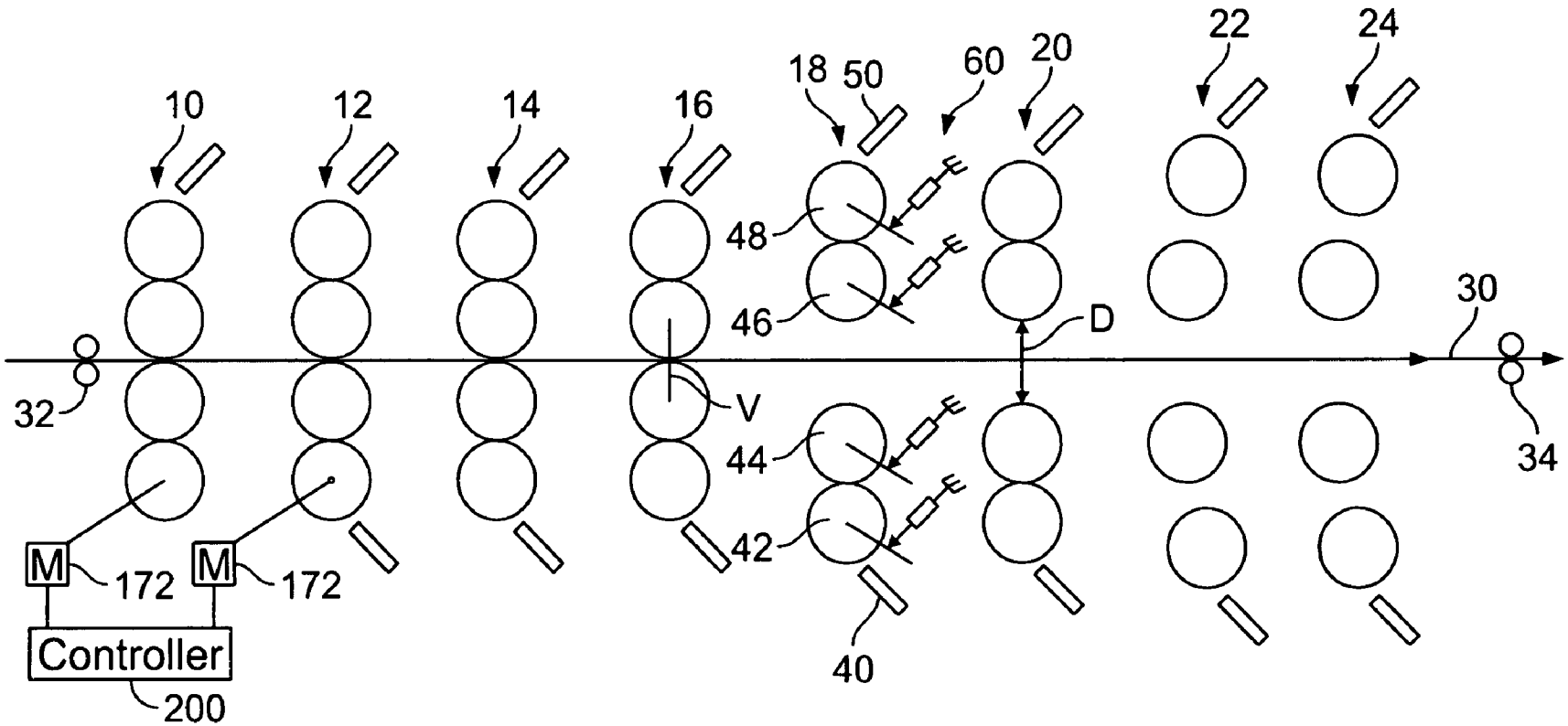
FIG. 1 shows a web offset printing press having eight print units according to the present invention.

FIG. 1 shows a web offset printing press having eight offset print units 10, 12, 14, 16, 18, 20, 22, 24, each having a plate cylinder 42, blanket cylinder 44, plate cylinder 48 and blanket cylinder 46. Blanket cylinders 44 and 46 nip a web 30 in a printing mode, as shown for print units 10, 12, 14, 16, which may print black, cyan, yellow and magenta, respectively for example. The web may enter the print units via nip rollers 32 (which may be infeed rollers for example) and may exit via exit rollers 34, which may for example be located downstream of a dryer.

The blanket cylinders 44, 46 for each print unit may be thrown-off, as shown for units 22 and 24, so as to separate from each other and from the respective plate cylinder 42, 48. Plate cylinders 42, 48 may move back into contact with the blanket cylinders 44, 46, respectively, during an automatic plate change operation, for example via automatic plate changers 40 and 50, respectively. Automatic plate changers are described in U.S. Pat. Nos. 6,053,105, 6,460,457 and 6,397,751 and are hereby incorporated by reference herein.

A throw-off mechanism 60 is shown schematically for moving the blanket and plate cylinders 42, 44, 46, 48. Preferably, each print unit is driven by a single motor 172. Each print unit 10, 12 . . . 24 may be the same. The individual motors may be controlled by a common control unit 200, which can also control each throw-off mechanism and each autoplating unit for the entire press.

The web path length between the nip rollers 32, 34 advantageously need not change, even when one of the print units has blanket cylinders which are thrown off. Registration may be unaffected by the throw-off. In addition, no web deflectors or stabilizers are needed, such as lead rolls or air rolls to make sure the web does not contact the blankets 44, 46, which could cause marking.

The throw-off distance D preferably is at least 1 cm and most preferably at least 2.5 cm, i.e. that the web has 1.25 cm clearance on either side of the web. Moreover, the centers of the blanket cylinders 44, 46 preferably are in a nearly vertical plane V, which is preferably 10 degrees or less from perfect vertical. This has the advantage that the throw-off provides the maximum clearance for a horizontally traveling web.

Figure 2:
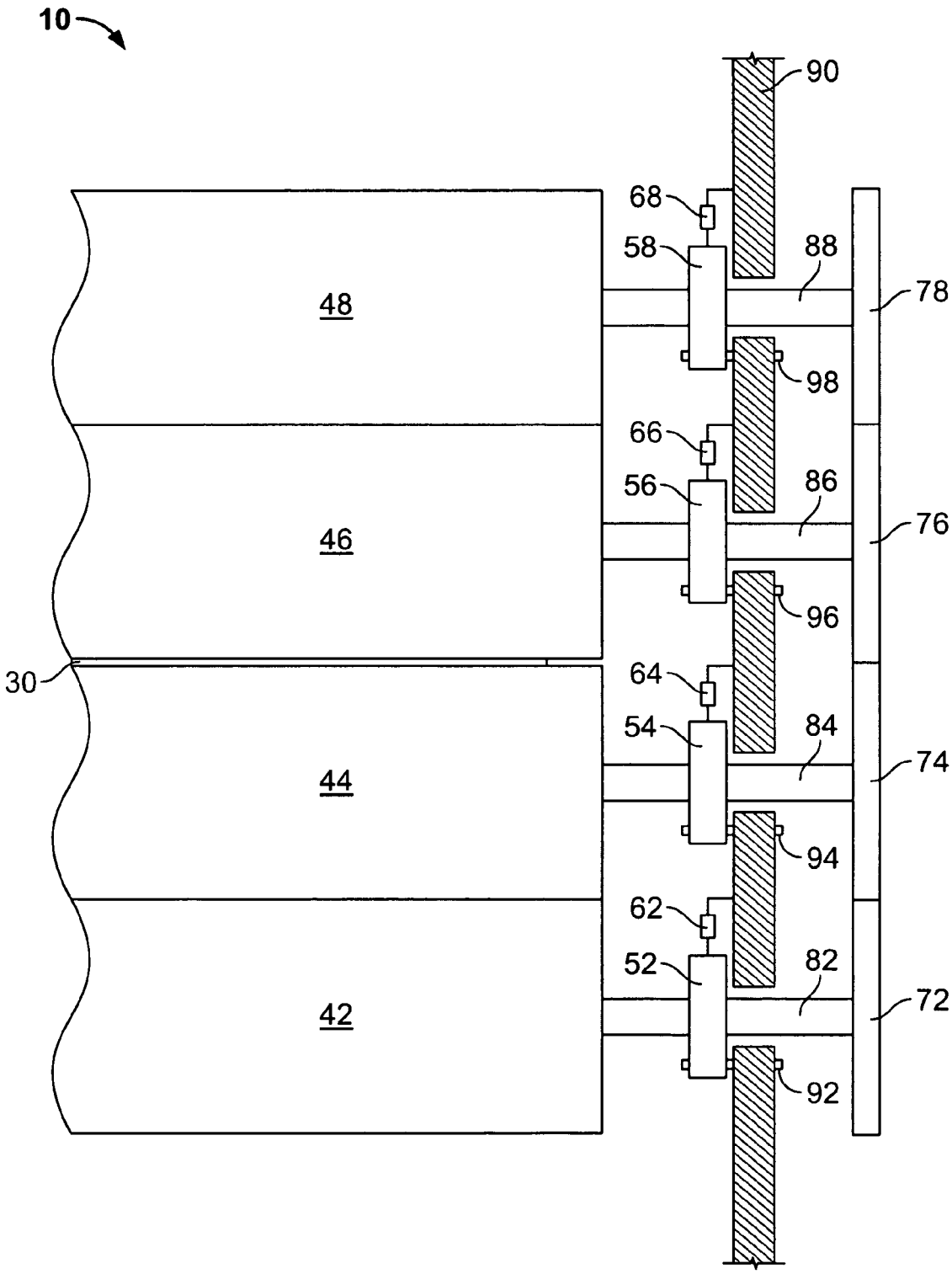
FIG. 2 shows a schematic view of the print unit according to the present invention when the web is engaged.

The creation of the large throw-off distance D requires changes from normal gearing and is explained with an exemplary embodiment as follows:

FIG. 2 shows a side view of a print unit 10, for example, in FIG. 1, printing web 30. The web 30 is in contact with blanket cylinders 44, 46, which are in contact with plate cylinders 42, 48, respectively. The cylinders 42, 44, 46, 48 have axle ends 82, 84, 86, 88, which are supported by pivotable support housings 52, 54, 56, 58, which in turn are supported on a frame 90 by pivots 92, 94, 96, 98, respectively. Throw-off actuators 62, 64, 66, 68 of throw-off mechanism 60 (FIG. 1) may pivot the support housings 52, 54, 56, 58 about the pivots 92, 94, 96, 98, respectively. These actuators may be pneumatically operated for example. At the ends of the axle ends 82, 84, 86, 88 are gears 72, 74, 76, 78 respectively, which are geared together during printing.

Figure 5:
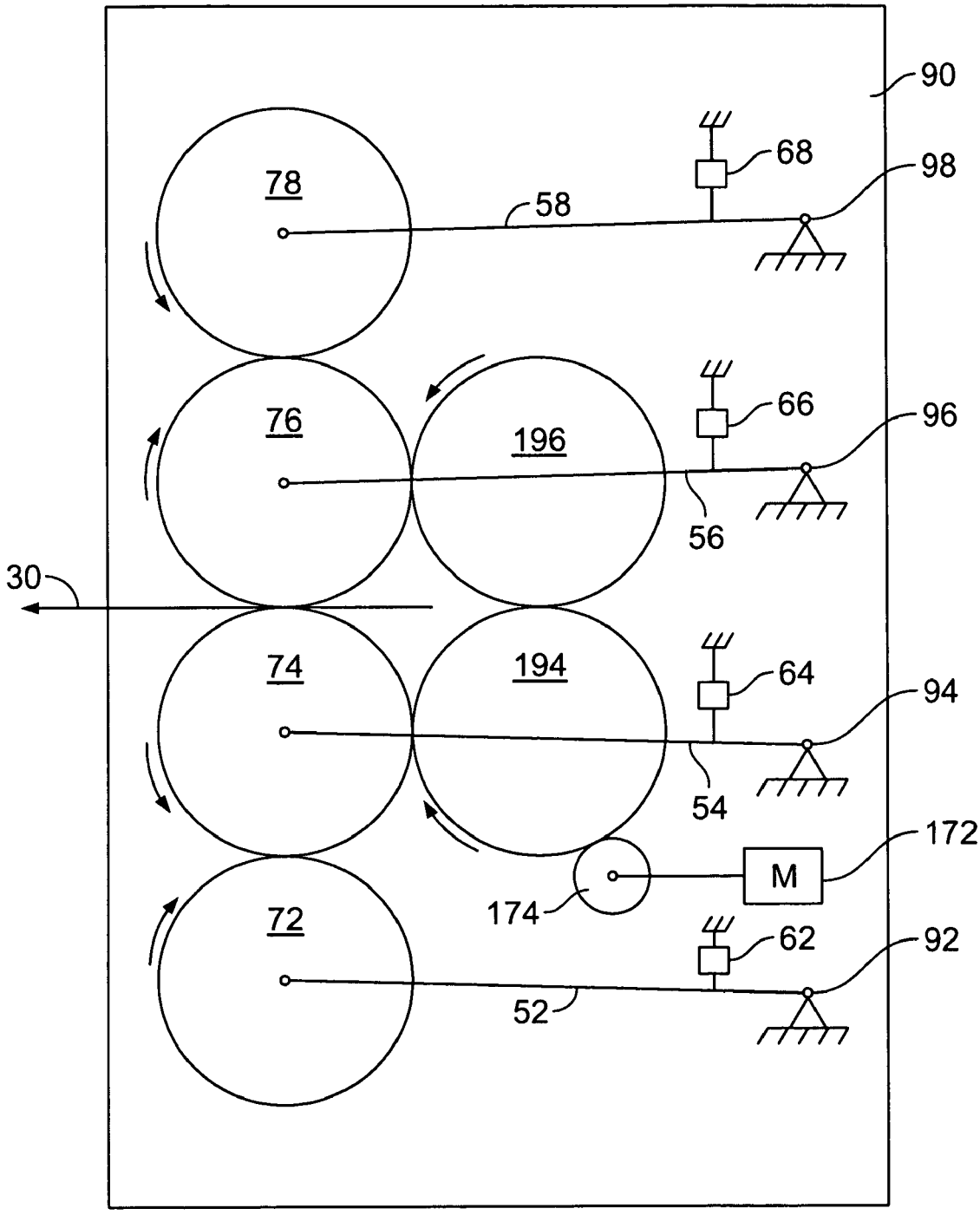
FIG. 5 shows a schematic end view of the print unit in FIG. 2.

FIG. 5 shows a schematic end view of the gears 72, 74, 76, 78 and their respective support housings 52, 54, 56, 58, pivots 92, 94, 96, 98 and throw-off actuators 62, 64, 66, 68. Two gears 194, 196 supported in frame 90 connect to gears 76 and 74 respectively. A drive gear 174 driven by motor 172 can drive for example gear 194, which in turn drives gears 74 and 196. Gears 174, 194 and 196 may be supported in frame 90 so that their axes do not translate.

Figure 3:
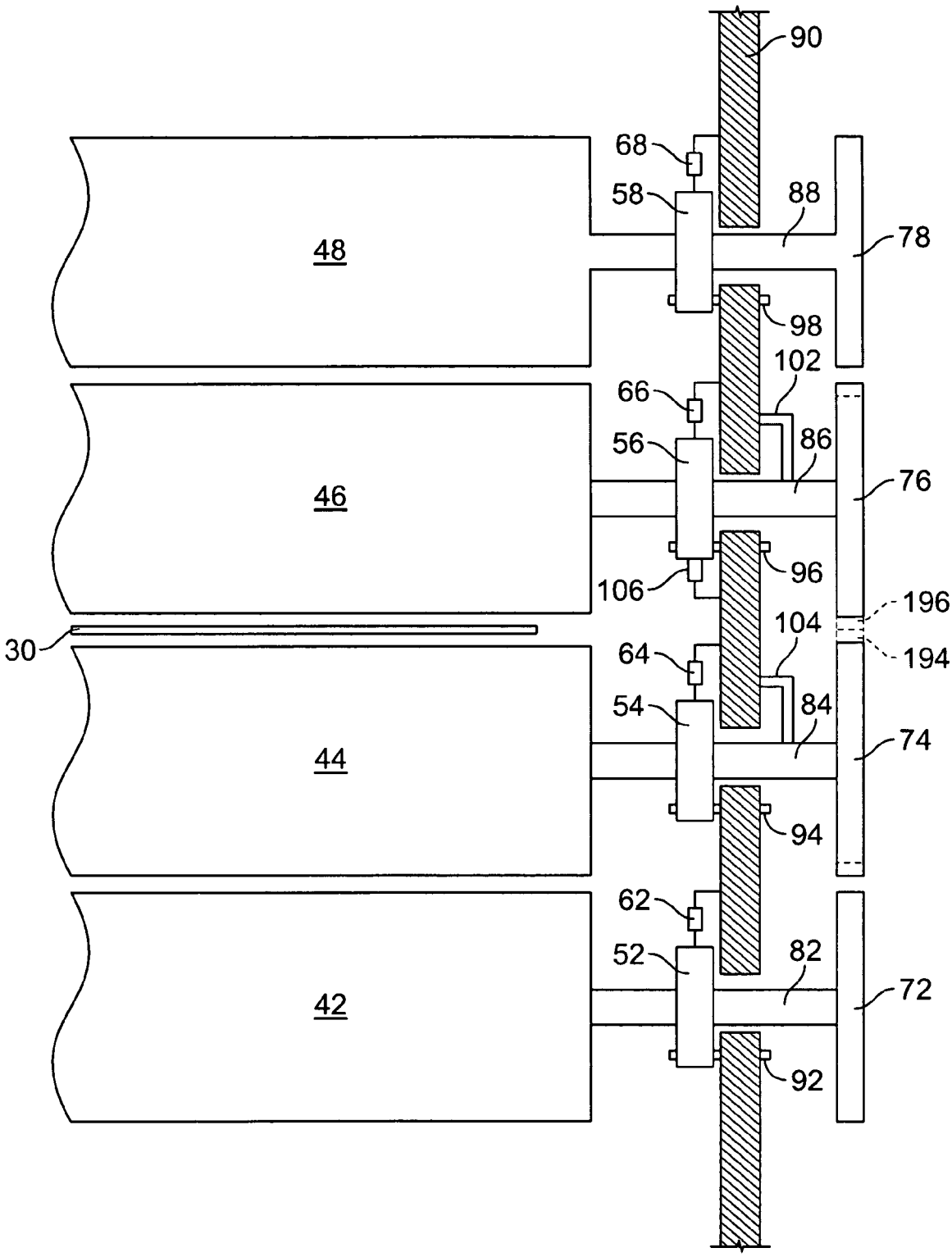
FIG. 3 shows the print unit in FIG. 2 when the blankets are in a throw-off position and disengaged from the plate cylinder

FIG. 3 shows the blanket cylinders 44, 46 thrown off, and the plate cylinders 42, 48 also separated from their respective blanket cylinders 44, 46. The blanket cylinders 44, 46 may be cantilevered using counterpoise devices 102, 104 respectively, and a support device 106 can add additional support to support housing 56, for example. In this position, sleeve shaped blankets on the cantilevered blanket cylinders 44, 46 may be removed via the work-side end as for example described in incorporated-by-reference U.S. Pat. No. 5,678,485.

Figure 6:
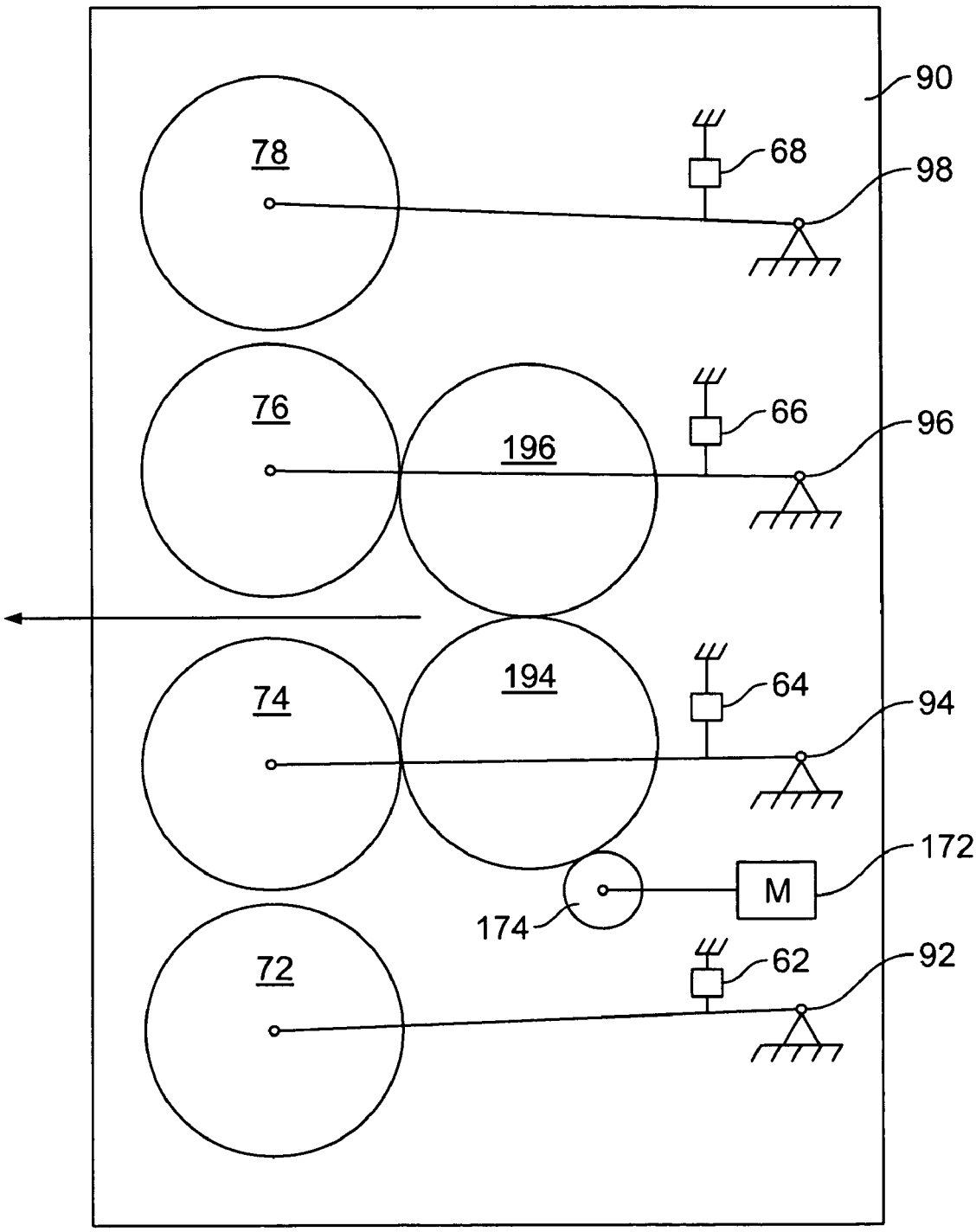
FIG. 6 shows a schematic end view of the print unit in FIG. 3.

While gears 72, 74, 76 and 78 are disengaged, gears 194 and 196 remain engaged, as shown also in FIG. 6.

Figure 4:
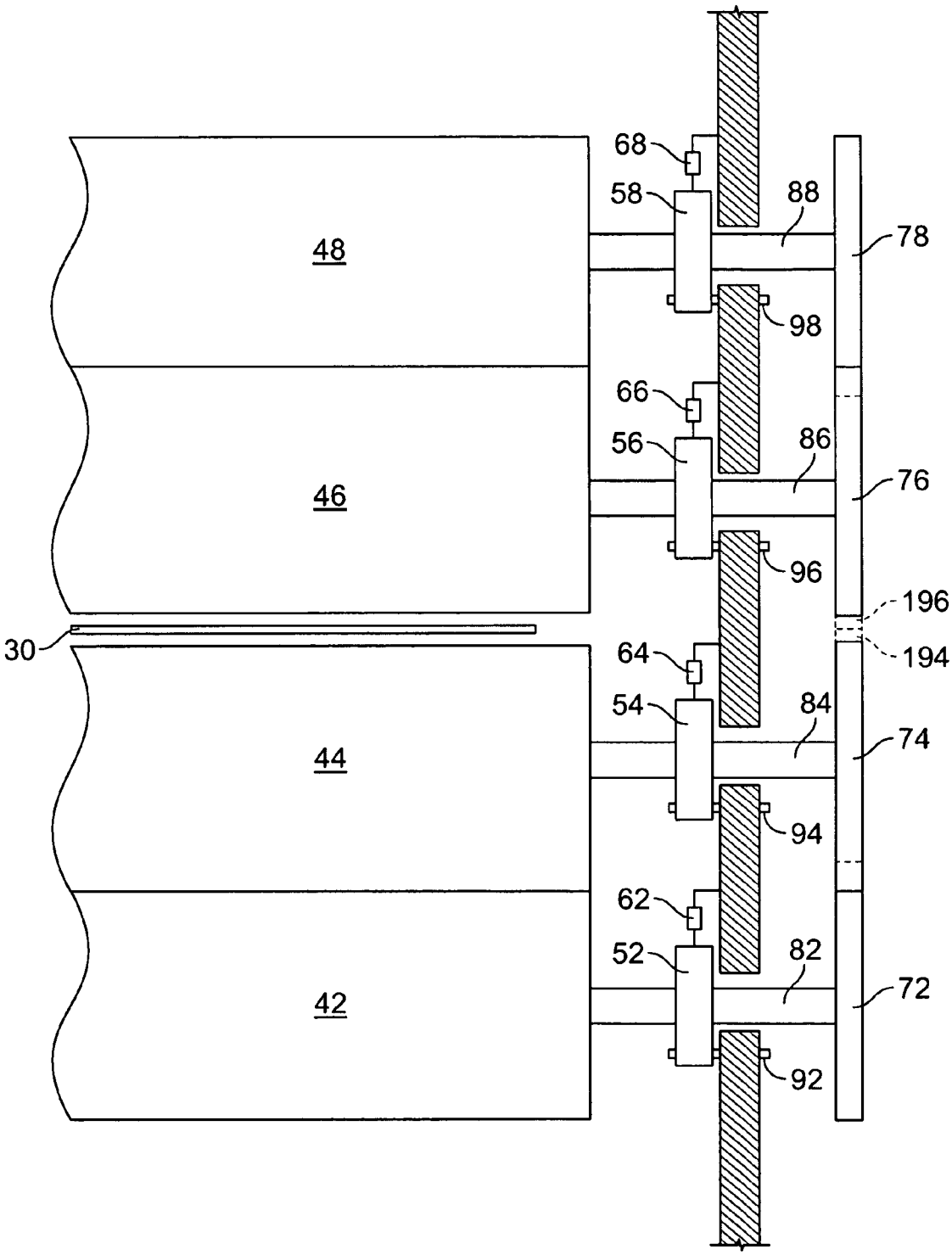
FIG. 4 shows the print unit in FIG. 3 when the blankets are thrown off but the plate cylinders are against the blanket cylinders to permit autoplating.

FIG. 4 shows the plate cylinders 42, 48 back in engagement with the respective blanket cylinders 44, 46, but the blanket cylinders 44, 46 remaining thrown-off. Since gears 72 and 74 and 76 and 78 are now engaged, even though gears 74 and 76 are not engaged, the plate cylinders 42 and 48 can be driven for autoplating via gears 194 and 196 by motor 172 and gear 174.

Autoplate units 40 and 50 thus can each function using a single drive motor even while the blanket cylinders 74 and 76 remain thrown-off.

What is claimed is:

1. A shaftless web offset printing press comprising:

a first printing unit comprising:

a first plate cylinder;

a first blanket cylinder selectively in contact with the first plate cylinder;

a second blanket cylinder, the web passing between the first and second blanket cylinders, the second blanket cylinder and first blanket cylinder being selectively disengageable from the web in a throw-off position to permit the web to pass between the first and second blanket cylinders;

a second plate cylinder selectively engageable with the second blanket cylinder;

a single drive motor driving the first plate cylinder, first blanket cylinder, second blanket cylinder and second plate cylinder when the first and second blanket cylinders engage the web, the single drive motor capable of rotating the first and second plate cylinders when the first and second blanket cylinders are in the throw-off position; and a gearing arrangement connected to the first plate cylinder, the first blanket cylinder, the second blanket cylinder, the second plate cylinder and the single drive motor configured to selectively couple and decouple the first plate cylinder and the second plate cylinder to the single drive motor in the throw-off position without decoupling the first blanket cylinder and the second blanket cylinder from the single drive motor;

a second printing unit comprising:

a second unit first plate cylinder;

a second unit first blanket cylinder selectively in contact with the second unit first plate cylinder;

a second unit second blanket cylinder, the web passing between the second unit first and second blanket cylinders, the second unit second blanket cylinder and the second unit first blanket cylinder being selectively disengageable from the web in a throw-off position to permit the web to pass between the second unit first and second blanket cylinders;

a second unit second plate cylinder selectively engageable with the second unit second blanket cylinder; and a second unit single drive motor driving the second unit first plate cylinder, the second unit first blanket cylinder, the second unit second blanket cylinder and the second unit second plate cylinder when the second unit first and second blanket cylinders engage the web, the second unit single drive motor capable of rotating the second unit first and second plate cylinders when the second unit first and second blanket cylinders are in the throw-off position;

wherein the single drive motor and the second unit single drive motor are mechanically independent of each other.

2. The web offset printing press as recited in claim 1 further comprising a first autoplating unit for the first plate cylinder and a second autoplating unit for the second plate cylinder, the first autoplating unit operating when the single drive motor rotates the first plate cylinder and the second autoplating unit operating when the single drive motor rotates the second plate cylinder.

3. The web offset printing press as recited in claim 2 wherein the gearing arrangement includes a first plate cylinder gear engaged with a first blanket cylinder gear and a second plate cylinder gear engaged with a second blanket cylinder gear.

4. The web offset printing press as recited in claim 3 wherein the gearing arrangement includes a first further gear connected to the first blanket cylinder gear and a second further gear connected to the second blanket cylinder gear and the first further gear.

5. The web offset printing press as recited in claim 4 wherein the first further gear and second further gear are connected while the first and second autoplating units operate.

6. The web offset printing press as recited in claim 1 wherein the first blanket cylinder and second blanket cylinder have axially-removable sleeves.

7. The web offset printing press as recited in claim 1 further comprising a control unit controlling the single drive motor and a further drive motor of another print unit.

8. The web offset printing press as recited in claim 7 wherein the control unit further controls a plurality of throw-off mechanisms and a plurality of autoplating units for the web offset printing press.

9. The web offset printing press as recited in claim 1 wherein the first and second blanket cylinders separate during throw-off by at least 1 cm.

10. The web offset printing press as recited in claim 1 wherein the web passes between the first and second blanket during throw-off without the aid of any web deflectors or stabilizers.

11. The web offset printing press as recited in claim 1 further comprising infeed nip rollers upstream of the first printing unit and exit nip rollers downstream of the second printing unit.

12. The web offset printing press as recited in claim 11 wherein a web path length between the infeed nip rollers and exit nip rollers does not change when at least one blanket cylinder is disengaged from the web in a throw-off position.

13. The web offset printing press as recited in claim 1 wherein a center of the first blanket cylinder is preferably 10° or less from vertical with respect to a center of the second blanket cylinder or a center of the second unit first blanket cylinder is preferably 10° or less from vertical with respect to a center of the second unit second blanket cylinder.

14. The web offset printing press as recited in claim 1 further comprising a counterpoise device for cantilevering the first blanket cylinder.

15. The web offset printing press as recited in claim 2 wherein the first and second autoplating units operate while the first and second blanket cylinders are in a thrown-off position.

16. A web offset print unit comprising:

a first plate cylinder;

a first plate gear fixedly connected to the first plate cylinder;

a first blanket cylinder selectively in contact with the first plate cylinder;

a first blanket gear fixedly connected to the first blanket cylinder;

a second blanket cylinder, the web passing between the first and second blanket cylinders, the second blanket cylinder and first blanket cylinder being selectively disengageable from the web in a throw-off position to permit the web to pass between the first and second blanket cylinders;

a second blanket gear fixedly connected to the second blanket cylinder;

a second plate cylinder selectively engageable with the second blanket cylinder;

a second plate gear fixedly connected to the second plate cylinder and connected to the first plate gear via the first and second blanket gears;

a single motor driving the first plate gear, first blanket gear, second blanket gear and second plate gear, the first blanket gear and second blanket gear being engaged when the first and second blanket cylinders engage the web; and an at least one further gear connecting the first plate gear and the second plate gear in the throw-off position, the first and second blanket gears being disengaged from each other in the throw-off position, the single motor driving the first plate gear, the second plate gear and the at least one further gear when the first and second blanket cylinders are in the throw-off position.

17. The web offset printing unit as recited in claim 16 wherein the at least one further gear includes two further gears.

18. The web offset printing unit as recited in claim 16 further comprising a counterpoise device for cantilevering the first blanket cylinder.

19. A method for autoplating a first and a second plate cylinder of an offset print unit, the offset print unit also having a first and second blanket cylinder and a single drive motor, the method comprising the steps of:

throwing-off the first blanket cylinder and the second blanket cylinder from the web to permit the web to pass between the first and second blanket cylinders without contact so as to define a throw-off mode, removing the first plate cylinder from the first blanket cylinder and the second plate cylinder from the second blanket cylinder during throw-off mode to permit changing a first blanket on the first blanket cylinder and a second blanket on the second blanket cylinder, respectively, contacting the first plate cylinder with the first blanket cylinder during throw-off mode to permit the first plate cylinder to be rotated by the single drive motor, and contacting the second plate cylinder with the second blanket cylinder during throw-off mode to permit the second plate cylinder to be rotated by the single drive motor.

20. The method for autoplating a first and a second plate cylinder of an offset print unit as recited in claim 19 further comprising the step of:

gearing the first blanket cylinder to the second blanket cylinder via a first blanket cylinder gear, a first further gear, a second further gear and a second blanket cylinder gear, the first further gear and the second further gear being connected while the first blanket cylinder gear and second blanket cylinder gear being disengaged.

21. A web offset printing press comprising:

a plate cylinder;

a blanket cylinder selectively in contact with the plate cylinder;

a first gear coupled to the blanket cylinder;

at least one actuator for selectively coupling the plate cylinder and the blanket cylinder together in a throw-off position;

a single drive motor driving the plate cylinder and the blanket cylinder through the first gear, the single drive motor rotating the plate cylinder and the blanket cylinder when the plate cylinder and the blanket cylinder are coupled together in the throw-off position;

a second plate cylinder;

a second blanket cylinder selectively in contact with the second plate cylinder and the blanket cylinder;

a second gear coupled to the second blanket cylinder; and at least one second actuator for selectively coupling the second plate cylinder and the second blanket cylinder together via the second gear in the throw-off position;

the single drive motor driving the second plate cylinder and the second blanket cylinder through the second gear, the single drive motor rotating the second plate cylinder and the second blanket cylinder when the second plate cylinder and the second blanket cylinder are coupled together in the throw-off position.

* * * * *